United States Patent [19]

Gilbert et al.

[11] 4,178,980

[45] Dec. 18, 1979

[54] PROTECTION OF MOLTEN METAL

[75] Inventors: Ghislain Gilbert, Bures-sur-Yvette; Jean Galey, Voisins Bretonneux; Gérard Bentz, Elancourt-Trappes, all of France

[73] Assignee: L'Air Liquide, Societe Anonyme pour l'Etude et l'Exploitation des Procedes Georges Claude, Paris, France

[21] Appl. No.: 942,532

[22] Filed: Sep. 15, 1978

[30] Foreign Application Priority Data

Sep. 22, 1977 [FR] France ..... 77 28561

[51] Int. Cl.[2] ..... B22D 21/02

[52] U.S. Cl. ..... 164/66; 164/82; 164/259; 164/415; 75/96; 266/207; 222/603

[58] Field of Search ..... 164/66, 67, 82, 259, 164/438, 437, 335, 133, 415; 222/590, 591, 603; 75/96; 266/207

[56] References Cited

U.S. PATENT DOCUMENTS 4,093,553 6/1978 Galey et al. ..... 75/96

FOREIGN PATENT DOCUMENTS 7147529 12/1971 France ..... 164/66

*Primary Examiner*—Robert D. Baldwin
*Assistant Examiner*—K. Y. Lin
*Attorney, Agent, or Firm*—Lee C. Robinson, Jr.

[57] ABSTRACT

A phase-separating member of annular form supplies a liquid phase, which converges towards a molten stream of metal. The liquid phase is distributed in the form of at least two layers, the upper layer meeting the metal stream at a distance h which is not greater than 300 mm from the bottom of the upper supply container, each layer forming an angle $\gamma$ greater than 30° with the said stream and being intended to protect a proportion of the vertical extent of the stream h not greater than 600 mm. The invention is applicable to protecting casting streams of large diameter and considerable height, in particular between the ladle and the tundish in the continuous casting of slabs.

7 Claims, 2 Drawing Figures

PROTECTION OF MOLTEN METAL

BACKGROUND OF THE INVENTION

The present invention relates to the protection of a stream of molten metal of substantially circular cross-section and of a mean diameter d, which flows vertically, over a height H, between an upper supply container and a lower receptacle, by means of a liquefied inert gas which is distributed by an apparatus comprising a phase-separating member of annular shape which surrounds the stream and which is intended to supply on the one hand the gaseous phase to form an atmosphere which envelops the upper part of the stream and on the other hand the liquid phase to form a substantially conical layer which converges towards the stream, which it meets at an angle $\gamma$.

At the present time protection of this kind is provided by means of installations which are equiped with phase separators of the kind described in French Patent specification No. 2,177,452. In their lower region, such separators have orifices from which the liquid phase emerges, the said phase flowing out in the form of a single layer. Experience has shown that such separators provide satisfactory protection for streams of small diameter (i.e. less than about 40 mm) which are released from a small height (i.e. less than about 900 millimeters) which is true of streams for casting billets or blooms between the tundish and the casting line. However, this protection ceases to be adequate as soon as the stream reaches a diameter greater than approximately 40 mm and a height greater than approximately 900 mm, which is the case with streams used in the continuous casting of slabs between the ladle and the tundish.

Studies made of the structure of the layer of liquid supplied by existing separators have shown that a spheroidalising effect arises from contact with the fast moving liquid metal, and as a result the liquefied gas does not flow along the stream of metal while forming a protective sheath but rebounds from the said stream and tends to break up into drops of greater or lesser size. These studies have also shown that corresponding to the angle of incidence i between the liquefied gas and metal, that is to say to the angle which the layer of liquid forms when it meets the stream of metal, is an angle of reflection $r<i$. As a result, it drops are to be prevented from rebounding and adequate protection provided for the metal, the conditions under which the liquefied gas provides protection for the casting stream must be governed by the diameter d and the height H of the said stream.

Principally, the present invention has as an object the avoidance or minimisation of the drawbacks of known methods of protecting streams of metal so that satisfactory protection may be provided for such streams even when their diameter and height become considerable.

SUMMARY OF THE INVENTION

To this end the invention proposes a method which, when $d>40$ mm and $H>900$ mm, the liquid phase is distributed in the form of at least two layers, the upper layer meeting the stream of metal at a distance $h_o<300$ mm from the bottom of the upper supply container, each layer forming with the said stream an angle $\gamma<30°$ and being intended to protect a proportion of the vertical extent of the stream $h\leqq 600$ mm.

The use of a plurality of layers of liquid rather than only one and the fact that the angle of incidence of each layer does not amount to 30 degrees makes it possible to form a layer of liquefied gas which flows uninterruptedly over the entire height of the stream and which forms around the stream a sheath of liquid which protects the stream from the effects of the ambient air.

In accordance with another feature of the invention, the said angle $\gamma$ is preferably substantially equal to 20°.

The invention also has as an object an apparatus for putting the above-mentioned method into practice, this apparatus being of the kind comprising a phase-separating member of annular form surrounding the stream which is provided with injectors which supply on the one hand the gaseous phase, which forms an inert atmosphere enveloping the upper part of the stream, and on the other hand the liquid phase, which forms a substantially conical layer converging towards the said stream, which it meets at an angle $\gamma$.

In accordance with the invention, with $d>40$ mm and $H>900$ mm, the said separating member has at least two superimposed tiers of injectors, each tier being situated in one and the same horizontal plane, the injectors in the upper tier forming, with the vertical, an angle $\alpha_o$ such that the layer emerging from the said upper tier meets the stream at a height $h_o\leqq 300$ mm from the bottom of the upper supply container, while each of the lower tiers forms, with the vertical, an angle $\alpha_1$, $\alpha_2$, etc. such that each layer meets the stream at an angle $\gamma<30$ degrees.

The presence of a plurality of tiers of injectors having a predetermined orientation enables a plurality of layers of liquid to be obtained which meet the stream of metal at an angle which prevents any rebounding in the form of droplets, these layers thus being responsible, in practice, for forming a uniform and continuous protective sheath.

BRIEF DESCRIPTION OF THE DRAWINGS

Other features and advantages of the invention will become apparent in the course of the following description, taken in conjunction with the accompanying drawings, which are given solely by way of non-limiting example, and in which.

DETAILED DESCRIPTION OF REFERRED EMBODIMENT

Figure 1:
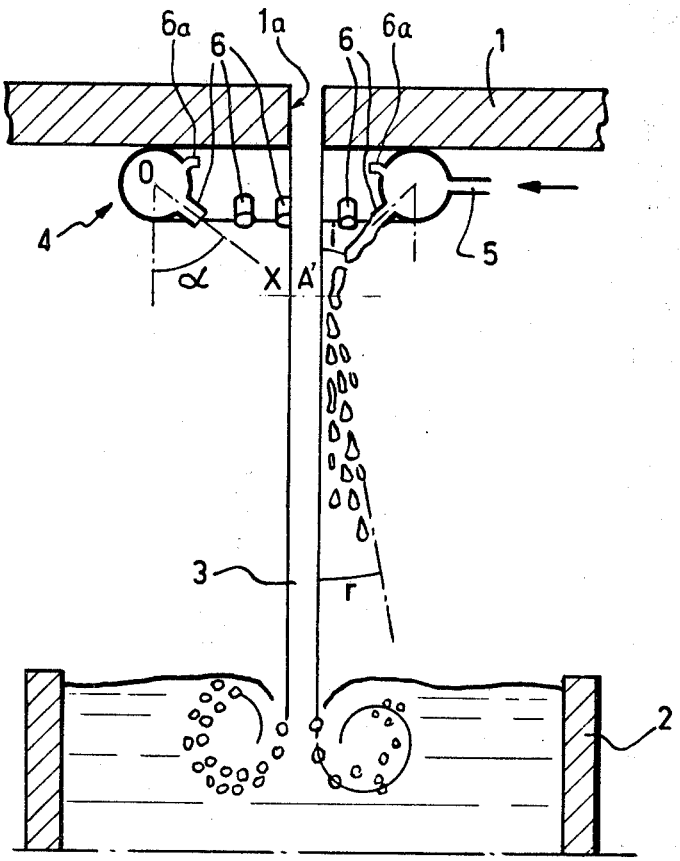
FIG.1 PRIOR ART
FIG. 1 is a schematic view in vertical section of a prior art protective apparatus.

Referring to FIG. 1, an upper supply container, which may for example be a casting ladle whose bottom is indicated at 1, contains a molten metal which flows out, through an orifice $\mathbf{1}_a$ in the said bottom, into a lower receptacle which may for example be an ingot mold whose upper part is shown at 2. The metal flows out in the form of a stream or vertical column 3. Protection is provided for the stream or column 3 by an apparatus comprising an annular phase separator 4 which surrounds the said stream or the like. The separator 4 is provided with an inlet duct 5 which receives a diphase mixture of liquefied inert gas, and with lower orifices 6 and upper orifices $\mathbf{6}_a$ which emit the liquid phase and gaseous phase respectively of the said mixture. The gaseous phase forms an atmosphere which envelops the upper part of the stream while the liquid phase forms a substantially conical layer which meets the vertical stream 3 at an angle of incidence i which is a function of the angle $\alpha$ formed by the axis OX of each of the orifices 6 with the vertical.

It has been found, by means of photographs and ultra high speed cinematography that, when the angle of incidence i is large, the layer of liquefied gas does not flow along the stream of metal while forming a sheath which surrounds the stream. In effect, as a result of the spheroidalising effect arising from contact with the liquid metal, the liquefied gas rebounds from the jet and breaks up into droplets of greater or lesser size which lie within a cone having an apex A' and a half apex-angle r, which latter may be considered as the angle of reflection of the liquefied gas which impinges at the angle of incidence i. From experiments, it has been found that angle r is less than angle i. On average, r is equal to $\frac{1}{2}$ or even $\frac{1}{3}$, at least in the case of liquid nitrogen.

It has also been found that as a result of the absence of a continuous layer of liquefied gas around the stream of metal, bubbles of atmospheric air are drawn into the metal in the receptacle 2 by a siphon effect, as shown in FIG. 1.

Experience has also shown that the liquefied gas, even if it impinges at a suitable angle to prevent any dispersion into droplets and thus forms a sheath surrounding the stream, will only protect the stream effectively for a height which does not exceed 600 mm, which is due to the evaporation of the liquefied gas which occurs after a certain time.

Finally, experience has shown that the transverse dimensions of the stream, that is to say its mean diameter, are an important factor and that present-day separators designed for streams of small diameter (14 to 20 mm) become ineffective with streams having a mean diameter greater than 40 mm.

To alleviate these various disadvantages, the invention therefore proposes that the liquid phase be ejected in the form of a plurality of layers which meet the stream of metal at different levels at angles $\gamma$ which it has been found must be less than 30°, preferably being of the order of 20°. The invention also proposes that the upper layer meet the stream at a height less than or equal to 300 mm from the bottom of the container 1 and that it protect the said stream for a height which does not exceed 600 mm.

Figure 2:
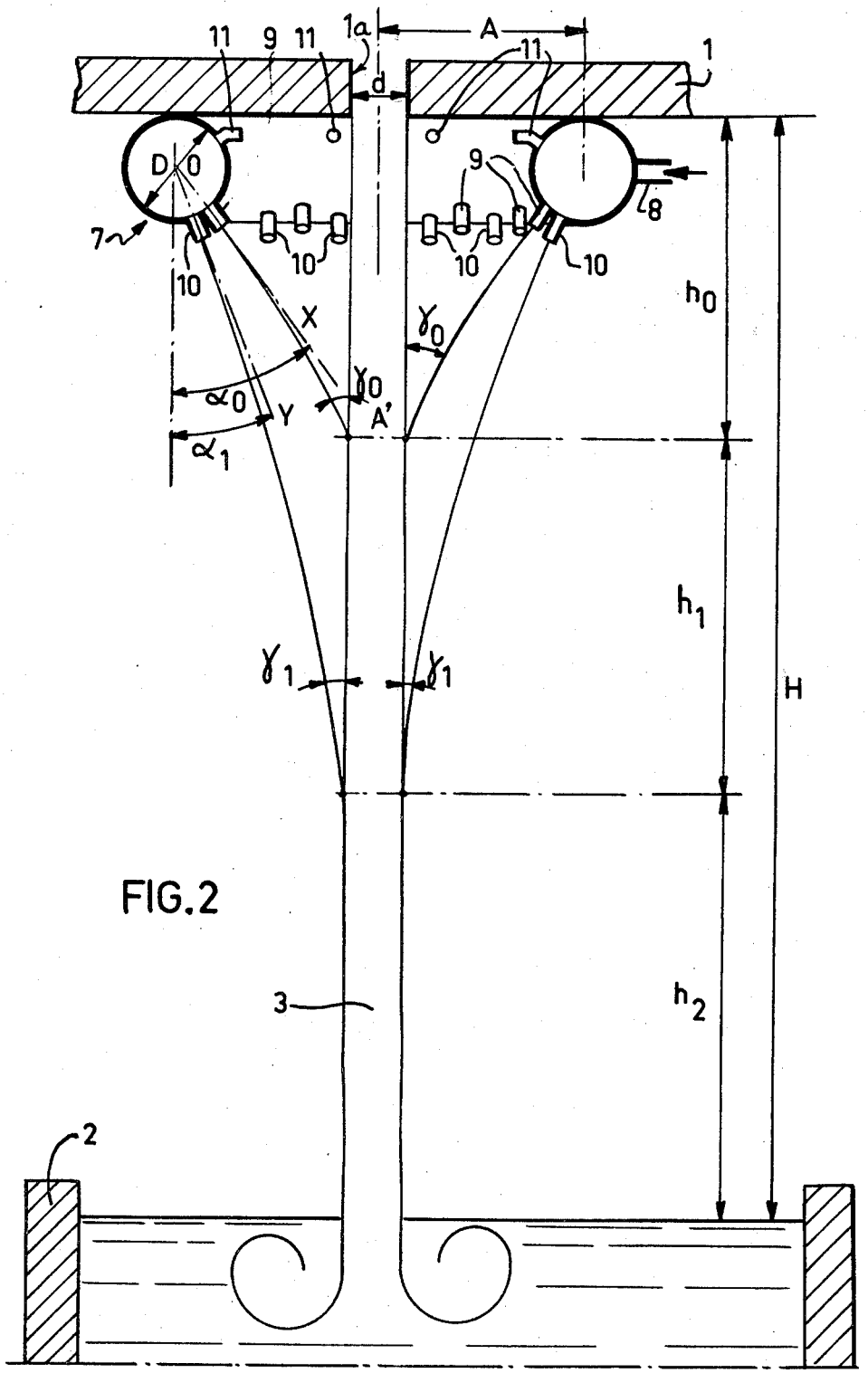
FIG. 2 is a schematic view in vertical section of a protective apparatus according to the invention.

Referring to FIG. 2, in which the same reference numerals indicate the same parts as in FIG. 1, it can be seen that the distributor 7, which is in the form of a torus arranged concentrically with the stream 3, has a duct 8 to supply diphase mixture, circumferentially distributed orifices situated in its lower region which deliver the liquid phase, these orifices being arranged in two superimposed tiers, an upper tier 9 and a lower tier 10, and orifices 11 situated in its upper region which deliver the gaseous phase.

In FIG. 2 the following references are also used to identify the following items:

d is the mean diameter of the stream 3,

D is the diameter of the generating circle for the torus forming the separator 7, O is the centre of the said circle, A is the radius to the axis of the torus, $\alpha_o$ is the angle which the axis OX of the injectors 9 forms with the vertical, $\alpha_1$ is the angle which the axis OY of the injectors 10 forms with the vertical, $\gamma_o$ is the angle which the layer emerging from injectors 9 forms with the stream 3, $\gamma_1$ is the angle which the layer emerging from injectors 10 forms with the stream 3, H is the overall height of the stream 3, $h_o$ is the distance between the bottom of the container 1 and the point of impingement of the layer emerging from injectors 9, $h_1$ is the distance between the points of impingement of the layers emerging from injectors 9 and 10, and $h_2$ is the distance between the point of impingement of the layer emerging from injectors 10 and the surface of the liquid in the receptacle 2.

The diameter D and the radius A of the torus are governed by the diameter d of the stream, while the number of tiers of injectors and the inclinations of the injectors to the vertical are a function of the height H.

Dimensions of the Torus

Bearing in mind the conditions set forth above relating to the desirable vertical extent of the protection provided for the stream by the gaseous atmosphere and relating to the angle of incidence of the liquid phase against the stream, the following formulae have been drawn up which give the diameter D and the radius A respectively:

$$A\,(\text{mm}) = 120 + \frac{2\,d\,(\text{mm})}{3}$$

$$D\,(\text{mm}) = \frac{180 + d\,(\text{mm})}{3}$$

It can be seen that these toruses have a generating circle whose diameter is substantially equal to half their radius to the axis.

Number of Tiers of Injectors

This is principally a function of the height H. It is also known that the gaseous atmosphere protects the stream for a height of 300 mm and in addition that one tier of injectors cannot protect the stream for a height of more than 600 mm.

(I) $H \leqq 900$ mm.

It can be said that:

$$H_{max} = h_o + h_1 = 300 + 600 = 900 \text{ mm.}$$

A single tier of injectors is sufficient.

(II) $900 \leqq H \leqq 1500$

It can be said that:

$$H_{max} = h_o + h_1 + h_2 = 300 + 600 + 600 = 1500$$

Two tiers of injectors are required.

(III) $1500 \leqq H \leqq 2100$.

It can be said that:

$$H_{max} = h_o + h_1 + h_2 + h_3 = 300 + 600 + 600 + 600 = 2100$$

Three tiers of injectors are required.

Angles of Incidence and Injector Angles:

$\alpha_o$: this angle may be such that $h_o$ is less than or equal to 300 mm.

In practise $\alpha_o$ is made to equal to 45 degrees whatever the nature of the torus, which means a value of approximately 230 mm for $h_o$. $\alpha_1$: this angle is determined on the basis of $h_o$ and $h_1$, expressed in meters, by means of the following formula:

$$\alpha_1 = \text{arc. sin} \frac{4 - 20\sqrt{3(h_0 + h_1)}}{8 - 80(h_0 + h_1)}$$

$\alpha_2$: this angle is determined in the same way, on the basis of $h_o$, $h_1$ and $h_2$ expressed in meters, and is given by:

$$\alpha_2 = \text{arc. sin} \frac{4 - 20\sqrt{3(h_0 + h_1 + h_2)}}{8 - 80(h_0 + h_1 + h_2)}$$

Example of Application

By way of example, there are given below the characteristics of a toroidal phase separator for protecting a stream of metal having a mean diameter d=16 mm and a height H=1.5 meters.

These characteristics, of which several are obtained by the above mentioned formulae, are as follows:

D=86 mm,

A=160 mm,

Number of tiers of injectors: 2, $\alpha_o$=45 ($h_o$ equals 230 mm)

$\alpha_1$=28°35'.

Number of injectors per tier: 36

Diameter (bore) of an injector: 2 mm

Length of an injector 15 mm

Calculation suggests and experience confirms that the values of the angles of incidence of the two layers liquefied gas against the stream of metal are respectively $\alpha_o$=23°12' and $\alpha_1$=11°50'

This method and apparatus according to the invention are applicable to protecting a stream whose mean diameter is greater than 40 mm and may be as much as 120 mm and whose height is greater than 900 mm and may be more than 2 meters. They enable protection to be given to top-cast or bottom-cast steel between the ladle and the ingot mold or to continuously cast steel in particular between the ladle and the tundish, especially in the continuous casting of slabs. Finally the method and device can be applied for casting labs by means of a rotating casting nozzle, the ring-shaped distributor being provided to be fixed within said nozzle.

What we claim is:

1. A method of protecting a stream of molten metal of substantially circular cross-section and of a mean diameter d, which flows vertically, over a height H, between an upper supply container and a lower receptacle, by means of a liquefied inert gas which is distributed by an apparatus comprising a phase-separating member of annular form which surrounds the stream and which is intended to supply on the one hand the gaseous phase to form an atmosphere which envelops the upper part of the stream and on the other hand the liquid phase to form a substantially conical layer converging towards the stream, which it meets at an angle $\alpha$, which method consists in that, with d greater than 40 mm and H greater than 900 mm, said liquid phase is distributed in the form of at least two layers, the upper layer meeting said stream of metal at a distance $h_o$ which is not greater than 300 mm from the bottom of said upper supply container, each layer forming with said stream an angle $\gamma$ which is not greater than 30° and being intended to protect a proportion of the vertical extent of the stream h not greater than 600 mm.

2. A method according to claim 1, wherein said angle $\gamma$ is preferably substantially equal to 20°.

3. Apparatus for protecting, by means of liquefied inert gas, a vertical stream of molten metal of substantially circular cross-section and of a mean diameter d which flows vertically, over a height H, between an upper supply container and a lower receptacle, of the kind comprising a phase-separating member of annular form which is adapted to surround said stream and which is provided with injectors which supply on the one hand a gaseous phase, which forms an inert atmosphere enveloping the upper part of the stream, and on the other hand a liquid phase, which forms a substantially conical layer converging towards said stream which it meets at an angle $\gamma$, wherein said apparatus consists in that, with d greater than 40 mm and H greater than 900 mm, said separator has at least two tiers of injectors for injecting said liquid phase which tiers are regularly distributed in two superimposed circles each situated in a single horizontal plane, the injectors in said upper tier forming an angle $\alpha_o$ with the vertical such that the layer emerging from said upper tier meets the stream of metal at a height h which is not greater than 300 mm from the bottom of said upper container while each of said lower tiers forms an angle $\alpha_1$, $\alpha_2$, etc. with the vertical such that each layer meets said stream at an angle $\gamma_o$, $\gamma_1$, $\gamma_2$, etc. less than 30°.

4. Apparatus according to claim 3, wherein said angle $\alpha_1$, is such that $\gamma_1$ is of the order of 20°.

5. Apparatus according to claim 3, which takes the form of a torus having a radius A (mm) to the axis=120+(2d/3) mm, the generating circle having a diameter D which is substantially equal to A/2 (mm).

6. Apparatus according to claim 5, wherein said upper tier of the liquid phase injectors forms an angle $\alpha_o$=45° with the vertical and $h_o$=230 mm.

7. Apparatus according to claim 6, wherein each of said lower tiers of injectors forms, with the vertical, an angle:

$$\alpha_1 = \text{arc. sin} \frac{4 - 20\sqrt{3(h_0 + h_1)}}{8 - 80(h_0 + h_1)}$$

$$\alpha_2 = \text{arc. sin} \frac{4 - 20\sqrt{3(h_0 + h_1 + h_2)}}{8 - 80(h_0 + h_1 + h_2)}$$

with $h_0 + h_1 + h_2 = H$

* * * * *